US005662277A

United States Patent [19]

Taubitz et al.

[11] Patent Number: 5,662,277

[45] Date of Patent: Sep. 2, 1997

[54] FUEL INJECTION DEVICE

[75] Inventors: Bernd Taubitz, Schwieberdingen; Michael Mettner, Ludwigsburg; Thanh-Hung Nguyen-Schaefer, Asperg, all of Germany

[73] Assignee: Robert Bosch GmbH, Stuttgart, Germany

[21] Appl. No.: 538,065

[22] Filed: Oct. 2, 1995

[30] Foreign Application Priority Data

Oct. 1, 1994 [DE] Germany ..... 44 35 270.0

[51] Int. Cl.[6] ..... B05B 1/30; F02M 51/00

[52] U.S. Cl. ..... 239/585.4; 239/533.12

[58] Field of Search ..... 239/533.12, 585.1–585.5, 239/590.5, 575, 590.3, 553.3

[56] References Cited

U.S. PATENT DOCUMENTS

| | | | |
|---|---|---|---|
| 4,057,190 | 11/1977 | Kiwior et al. . | |
| 4,519,370 | 5/1985 | Iwata | 239/533.12 X |
| 5,423,489 | 6/1995 | Wood | 239/DIG. 23 X |
| 5,484,108 | 1/1996 | Nally | 239/585.4 X |
| 5,540,387 | 7/1996 | Reiter et al. | 239/596 X |

FOREIGN PATENT DOCUMENTS

| | | | |
|---|---|---|---|
| 0 302 660 | 2/1989 | European Pat. Off. . | |
| 27 23 280 | 12/1977 | Germany . | |
| 160151 | 7/1991 | Japan | 239/533.12 |
| 2023226 | 12/1979 | United Kingdom . | |
| WO 92/13188 | 8/1992 | WIPO . | |

OTHER PUBLICATIONS

Heuberger: "Mikromechanik" [Micromechanics], Springer–Verlag 1989, p. 236 ff.

Reichl: "Micro System Technologies 90", Springer–Verlag 1990, p. 521 ff.

*Primary Examiner*—Kevin Weldon

*Attorney, Agent, or Firm*—Kenyon & Kenyon

[57] ABSTRACT

A fuel injection device having an injection valve on which an atomizing grid is arranged. The disk-shaped atomizing grid is arranged downstream of a valve seat face and is equipped with an atomizing structure which at least partially possesses variations in cross section in the axial direction, over the thickness of the atomizing grid. As a result of the geometry of the atomizing grid, the fuel is atomized particularly finely into very small droplets without auxiliary energy. The fuel injection device is particularly suitable for use in fuel injection systems of mixture-compressing spark-ignition internal combustion engines.

17 Claims, 5 Drawing Sheets

FUEL INJECTION DEVICE

FIELD OF THE INVENTION

The present invention relates to a fuel injection device.

BACKGROUND INFORMATION

European Patent Application No. 0 302 660 describes a fuel injection valve, at the downstream end of which is provided an adaptor into which flows fuel which comes from an outlet orifice and which, at the downstream end of the adaptor, itself strikes a plane metal disk having meshes for the purpose of breaking up the fuel. The metal disk is arranged in such a way that an airstream, via holes in the adaptor, ensures that fuel drops caught on the metal disk are torn away. A better atomizing quality is therefore achieved only when the fuel is surrounded by an airstream near the metal disk, although an exact spray geometry cannot be achieved by means of this airstream. The square meshes of the metal disk are of equal size on account of the uniform network and form a checked pattern which is symmetrical in all directions. The network of the metal disk is therefore of grid-like design, the network having no variations in cross section in the axial direction. Consequently, no special atomizing edges are provided.

Moreover, it is described in German Patent Application No. DE 2 723 280 to design on a fuel injection valve, downstream of a metering orifice, a fuel breakup member in the form of a plane thin disk which has a multiplicity of arcuate narrow slits. The arcuate slits, which are made in the disk by etching, ensure by means of their geometry, that is to say by means of their radial width and their arc length, that a fuel film which breaks up into small droplets is formed. The etching operation for making the slits is cost-intensive. Furthermore, the individual slit is have to be made highly accurately relative to one another, in order to ensure that the fuel is broken up in the desired way. The arcuate slits each have a constant aperture width over the entire axial extension of the breakup member. Atomization is therefore to be improved by means of the horizontal radial geometry of the slits in the plane of the breakup member.

The so-called LIGA process for the production of micromechanical components is described in, for example, Heuberger: "Mikromechanik" ("Micromechanics"), Springer-Verlag 1989, page 236 ff., and Reichl: "Micro System Technologies 90", Springer-Verlag 1990, page 521 ff. This process involves the steps of lithography, electroforming and cast taking (Lithographie, Galvanoformung, Abformung). Extremely accurate microstructures can thereby be produced simply in a very good quality and in large quantities. In contrast to erosion processes for example, an incomparably wider diversity of geometries can be effected by means of the LIGA process.

A device for improving fuel atomization by feeding air into the liquid fuel upstream of an injection nozzle is also described in International Application No. WO 92/13188. The feed of the air takes place on the suction side, via an air-jet pump, under negative pressure into a fuel pump. The blowing-in of the air is carried out via a single bore into the fuel flow path, so that the fuel is enriched with inflowing air bubbles always at one point only.

SUMMARY OF THE INVENTION

The advantage of the fuel injection device according to the present invention, is that, at a low cost outlay, there can be provided on a fuel injection valve an atomizing grid which, without any auxiliary energy, contributes to a marked improvement in the atomizing quality. According to the present invention, the fuel striking the atomizing grid is atomized particularly finely into very small droplets which have a reduced so-called Sauter Mean Diameter (SMD), that is to say a reduced mean drop diameter of the sprayed fuel. As a consequence, inter alia, the exhaust-gas emission of an internal combustion engine can be further reduced and, likewise, a reduction in fuel consumption attained.

This is achieved according to the present invention in that the atomizing grid for the injection of fuels has novel atomizing structures which are distinguished particularly by an arrangement of atomizing webs with atomizing edges which are capable of being produced simply and highly variably, but which have a complicated geometry. The atomizing webs, or the entire atomizing structure, have in this case not only new geometries in the horizontal, that is to say radial direction, but also possess in the axial extension, that is to say over the thickness of the atomizing grid, variations in cross section which allow an optimum atomization of the fuel.

The fuel strikes the sharp-edged atomizing structures with their atomizing edges facing the valve closing body, and thereby becomes unstable and decomposes into relatively fine droplets. Downstream of the atomizing edges, local cavitations, that is to say regions of negative pressure, occur on account of the geometry of the atomizing structure, particularly because of the reduction in cross section of the atomizing webs. The result of the impact of the fuel on the atomizing structure is also that vortices and backflows occur in the atomized fuel downstream of the atomizing edges, these turbulences particularly increase the atomizing quality.

It is particularly advantageous to make the atomizing grids by means of the so-called LIGA or MIGA processes. Large quantities of atomizing grids with very small dimensions of the atomizing structures can thereby be produced with high dimensional accuracy. The atomizing grid can be fastened very simply to the injection valve, for example by means of adhesive bonding, soldering, welding or interlocking, either downstream of a spray-hole disk or directly downstream of a valve seat face without an additional spray-hole disk. If a spray-hole disk precedes the atomizing grid, so-called secondary atomization takes place on the atomizing grid.

It may be advantageous to provide an additional gas blow-in device in order to improve the atomization of the fuel according to the present invention. Even before the fuel injection valve is reached, a gas is blown into the fuel by means of this device. Advantageously, the gas feed takes place via a blow-in grid having a multiplicity of orifices. The blow-in grid can also be produced very easily by means of LIGA processes. To obtain the desired fuel pressure, directly after the gas has been blown in, the mixture of fuel and gas bubbles is braked by enlarging the cross section for the fuel flow again. With an increasing pressure the gas bubbles in the mixture are compressed. Up to a specific gas concentration in the mixture, a bubbly flow still prevails in the injection valve. Directly downstream of a sealing edge of the injection valve, the gas bubbles expand abruptly during injection and thus ensure a fine atomization of the fuel. The sharp-edged atomizing structure then ensures immediately thereafter a further improvement in atomization according to the operations already mentioned.

DETAILED DESCRIPTION OF THE INVENTION

Figure 1:
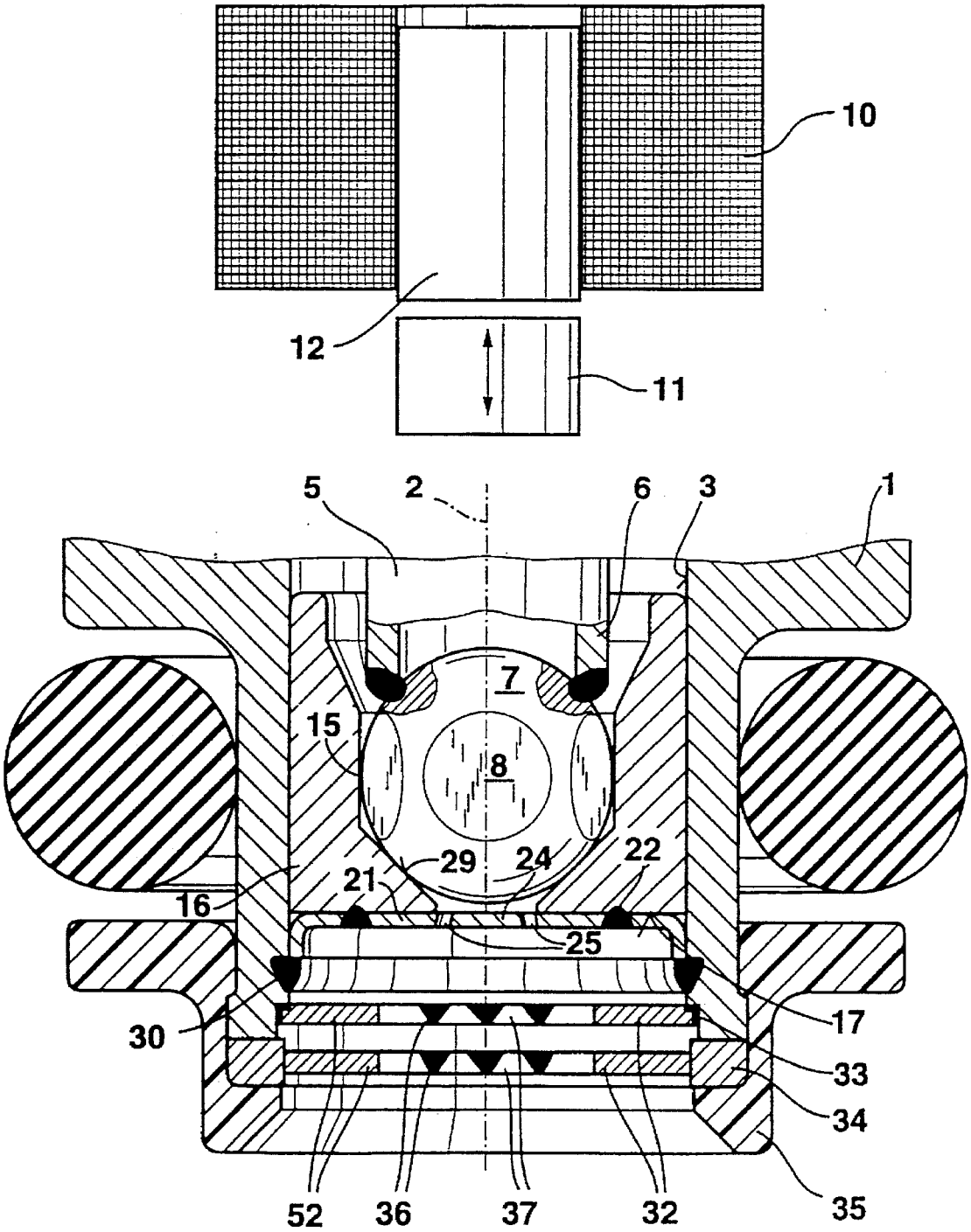
FIG. 1 shows a partially illustrated injection valve with atomizing grids according to the present invention.

FIG. 1 shows in part, as an exemplary embodiment according to the present invention, a valve in the form of an injection valve for fuel injection systems of mixture-compressing spark-ignition internal combustion engines. The injection valve has a tubular valve seat carrier 1, in which a longitudinal orifice 3 is formed concentrically to a valve longitudinal axis 2. Arranged in the longitudinal orifice 3 is, for example, a tubular valve needle 5 which is connected at its downstream end 6 to, for example, a spherical valve closing body 7, on the circumference of which are provided, for example, five flattenings 8.

The actuation of the injection valve takes place in a known way, for example electromagnetically. For the axial movement of the valve needle 5 and therefore for the opening, counter to the spring force of a return spring (not shown), and the closing of the injection valve, there serves an indicated electromagnetic circuit with a magnetic coil 10, an armature 11 and a core 12. The armature 11 is connected to the end of the valve needle 5 facing away from the valve closing body 7, for example by a welding seam by means of a laser and is aligned with the core 12.

A guide orifice 15 of a valve seat body 16 serves for guiding the valve closing body 7 during the axial movement. The cylindrical valve seat body 16 is sealingly fitted by welding into the downstream end of the valve seat carrier 1, facing away from the core 12, in the longitudinal orifice 3 extending concentrically relative to the valve longitudinal axis 2. On its lower end face 17 facing away from the valve closing body 7, the valve seat body 16 is connected concentrically and fixedly to, for example, a pot-shaped spray-hole disk 21 which thus bears directly on the valve seat body 16.

The connection of the valve seat body 16 to the spray-hole disk 21 takes place, for example, by means of a continuous, sealing, first welding seam 22 made by means of a laser. This type of mounting avoids the risk of an undesirable deformation of the spray-hole disk 21 in its central region 24, in which at least one, for example four, spray holes 25 formed by punching or erosion are located. The spray-hole disk 21 is connected, furthermore, to the wall of the longitudinal orifice 3 in the valve seat carrier 1, for example by means of a continuous, sealing, second welding seam 30.

The depth of insertion of the valve seat part including the valve seat body 16 and the potshaped spray-hole disk 21 into the longitudinal orifice 3 determines the size of the stroke of the valve needle 5, since one end position of the valve needle 5, with the magnetic coil 10 not energized, is fixed by the bearing of the valve closing body 7 on a valve seat face 29 of the valve seat body 16. The other end position of the valve needle 5, with the magnetic coil 10 energized, is fixed, for example, by the bearing of the armature 11 on the core 12. The distance between these two end positions of the valve needle 5 thus constitutes the stroke.

The spherical valve closing body 7 cooperates with the valve seat face 29 of the valve seat body 16, which valve seat face 29 narrows frustoconically in the direction of flow and is formed in the axial direction between the guide orifice 15 and the lower end face 17 of the valve seat body 16.

Downstream of the spray-hole disk 21, an atomizing grid 32 according to the present invention is arranged in the longitudinal orifice 3 of the valve seat carrier 1. The atomizing grid 32 is a thin disk which is fixedly connected, for example by means of adhesive bonding, to the valve seat carrier 1. The region of fastening of the atomizing grid 32 is shown merely by way of example and diagrammatically in FIG. 1, since the most diverse connection techniques 33 can be employed for fixing the atomizing grid 32, such as, for example, welding, soldering or interlocking. Alternatively to the atomizing grid 32 which, for example, is adhesively bonded in the longitudinal orifice 3, FIG. 1 also shows a second atomizing grid 32 which is limited in the circumferential direction by a peripheral clamping ring 34.

The atomizing grid 32 is clamped, gripped or cast round in the clamping ring 34. The clamping ring 34 allows a very simple mounting of the atomizing grid 32, since the atomizing grid 32 together with the clamping ring 34 can be gripped in one process step between the downstream end of the valve seat carrier 1 and a protective cap 35 forming the downstream termination of the injection valve. Mounting can take place, for example, in that the atomizing grid 32 is already inserted into the protective cap 35 and is then fastened, together with the protective cap 35, to the valve seat carrier 1 by virtue of the fact that the protective cap 35 and the valve seat carrier 1 make an interlocking connection. Further connecting methods 33 not described here, but perfectly normal, such as welding or soldering, are likewise possible for fastening the atomizing grid 32. However, the connection techniques 33 play only a minor role, since atomizing structures 36 in middle regions 37 of the atomizing grids 32 according to the present invention are decisive for a desired outstanding atomizing quality of the fuel.

The, for example, four spray holes 25 of the spray-hole disk 21 are distributed, for example, symmetrically about the valve longitudinal axis 2 in the form of corner points of a square and consequently in each case are at the same distance from one another and from the valve longitudinal axis 2. The fuel jets emerging from the spray holes 25 collide, downstream of the spray-hole disk 21, with the atomizing structures 36 of the atomizing grid 32. The collision or impact and flow-round of the fuel on the atomizing structures 36 according to the present invention constitute a particularly effective mode of treatment, in which atomization into particularly small droplets takes place and which is explained in more detail below. There therefore occurs at the atomizing grid 32 a so-called secondary atomization, by means of which the fuel droplets are further reduced in size. The arrangement of the spray-hole disk 21 is in no way a condition for the optimum effect of the atomizing grid 32; on the contrary, the atomizing arrangement without a spray-hole disk 21 downstream of the valve seat face 29 in the injection valve proves particularly effective.

Figure 2:
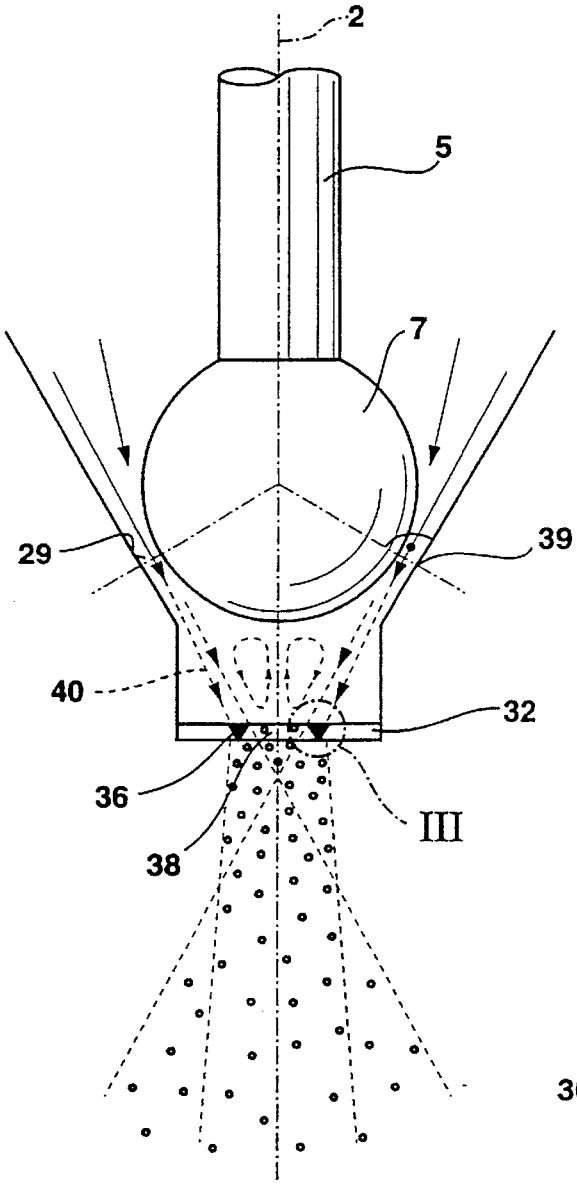
FIG. 2 shows a simplified region of atomization with an atomizing grid according to the present invention.

To explain the treatment principle in more detail, FIG. 2 shows in simplified form the spray region of the injection valve, particularly the regions around the valve seat face 29 and the atomizing grid 32. A spray-hole disk 21 is not provided in this case. The fuel emitted in the direction of the atomizing grid 32 when the valve closing body 7 is lifted off from the valve seat face 29 therefore strikes the atomizing structure 36 directly without the influence of a spray-hole disk 21.

By means of the atomizing grid 32 according to the present invention, the atomizing quality of the fuel is improved without additional auxiliary energy, in particular as a function of the new geometries of the atomizing structure 36. It has been customary, in injection valves, to carry out the atomization of the fuel, inter alia, by means of spray-hole disks 21. The pressure drop at the spray-hole disk 21 amounts to approximately 90% of the pressure difference between the injection valve and a suction pipe (not shown) of the internal combustion engine. As a result of viscous friction and turbulent dissipation, the pressure energy is converted into heat energy and, moreover, into kinetic energy. In the spray holes 25 of the spray-hole disk 21, the velocity of the fuel increases markedly on account of the narrowing in cross section which is a factor in the atomizing quality of the fuel. Due to contact with the sharp edges of the spray holes 25, the fuel jets downstream of the spray-hole disk 21 become unstable and turbulent on account of the disturbance of the surface of the fluid, here of the fuel, and the occurrence of local cavitation.

A turbulence of the fluid jet, expressed in a high Reynolds number, is necessary for a good atomization of the fuel. To generate the turbulence of the fuel jet, for example, the atomizing structure 36 according to the present invention, with its particular geometry, is appropriate. FIG. 2 shows diagrammatically the atomizing structure 36 and the fluid movements. In view of relatively large cross sectional areas, transverse to the valve longitudinal axis 2, of throughflow regions 38 between the atomizing structures 36, the pressure drop on the atomizing grid 32 is substantially lower than the pressure drop on the splay-hole disk 21. A large part of the total pressure drop in the injection valve therefore shifts to a sealing edge 39 which is formed on the valve seat face 29 exactly where, in the closed state of the injection valve, the valve closing body 7 bears largely with linear contact on the valve seat face 29. Consequently, the onflow velocity of the fluid jet 40 upstream of the atomizing grid 32 is higher than when there is a following spray-hole disk 21, so that high-quality atomization at the atomizing structure 36 is possible.

Figure 3:
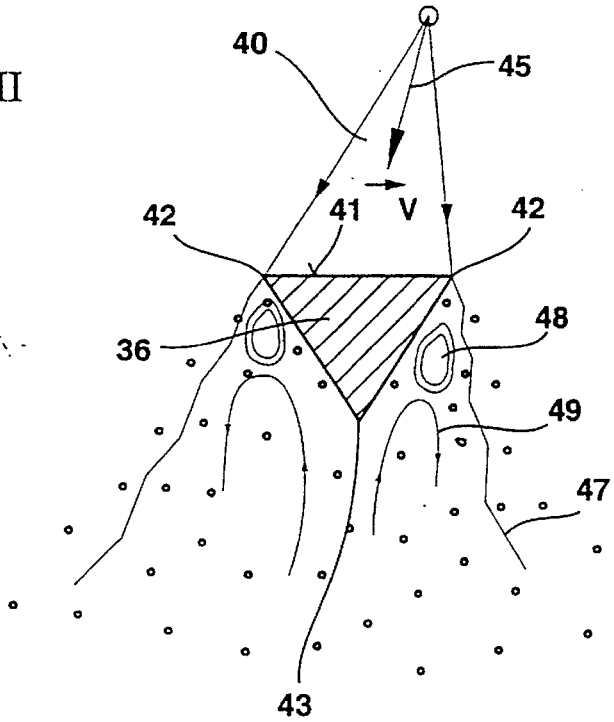
FIG. 3 show an enlargement of the atomizing structure of FIG. 2.

FIG. 3 once again shows enlarged a part region of the atomizing grid 32, the triangular grid profile becoming particularly clear in cross section. The atomizing grid 32 possesses, for example, a triangular atomizing structure 36 such that a plane face 41 points with an inner and an outer atomizing edge 42 towards the valve closing body 7, while a triangle vertex 43 is designed to face away from the valve closing body 7. The operation of atomizing the fuel according to the present invention can be seen from FIG. 3.

The fluid jet 40 at a high onflow velocity, indicated by an arrow 45, initially becomes unstable as a result of the onflow against the sharp-edged atomizing structure 36, particularly at the atomizing edges 42, and thereafter decomposes into fine droplets. Flow lines 47 extending from the atomizing edges 42 illustrate the instability of the fuel. Downstream of the atomizing edges 42, local cavitations 48, that is to say regions of negative pressure, occur as a result of the triangular geometry of the atomizing structure 36. The result of the impact of the fuel on the atomizing structure 36 is, also, that vortices or backflows 49 occur in the atomized fuel downstream of the atomizing edges 42. Moreover, the atomization of the fuel is improved by aerodynamic forces of the ambient air. The result is a fine fuel mist formed from very small droplets, the fuel droplets being distinguished by a markedly reduced so-called Sauter Mean Diameter (SMD), that is to say a reduced mean drop diameter of the sprayed fuel.

The aim of this mode of treatment is to spray particularly finely atomized fuel in the form of very small droplets out of the injection valve, in order, for example, to achieve very low exhaust-gas emissions of the internal combustion engine and to lower the fuel consumption. Precisely this requirement can be satisfied in a particularly advantageous way by means of the atomizing grid 32. In particular, the breakup of the fuel at the atomizing grid 32 gives rise downstream of the atomizing grid 32 to the fine droplet mist just described. These particularly small fuel droplets forming the droplet mist possess a substantially larger surface than the fuel jets before these strike the atomizing grid 32, this larger surface in turn indicating a good atomization. It can also be said that a fuel spray is formed downstream of the atomizing grid 32. This mode of operation just described also distinguishes all the exemplary embodiments of the atomizing structures 36 listed below.

Figure 4:
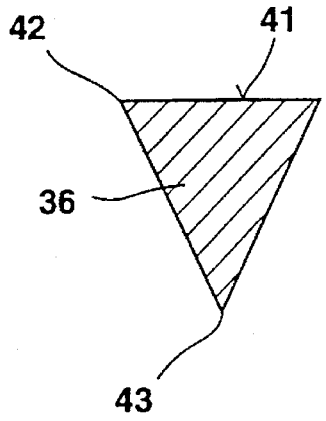
FIG. 4 illustrates an atomizing structure according to the present invention having a first triangular cross-section.
Figure 5:
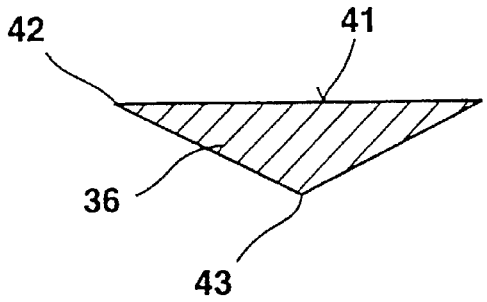
FIG. 5 illustrates an atomizing structure according to the present invention having a second triangular cross-section.

FIGS. 4 to 9 show in cross-section some advantageous atomizing structures 36 according to the present invention which can be produced simply and which can be used in atomizing grids 32 for injection valves. The angles of the fuel sprays can be varied by the different geometries of the atomizing structures 36. FIGS. 4 and 5 show triangular atomizing structures 36 which differ from one another in their angles. For example, on the one hand, an acute angle (FIG. 4) and on the other hand, in the exemplary embodiment of FIG. 5, an obtuse angle, is present at the triangle vertex 43 facing away from the valve closing body 7.

Figure 6:
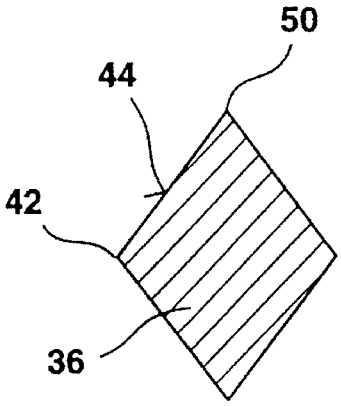
FIG. 6 illustrates an atomizing structure according to the present invention having a diamond-shaped cross-section.
Figure 7:
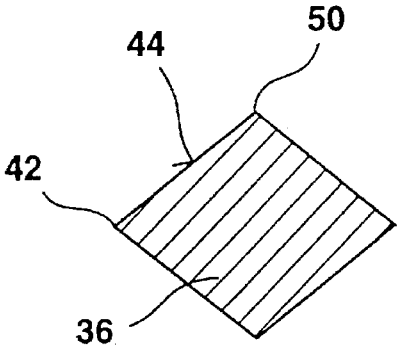
FIG. 7 illustrates an atomizing structure according to the present invention having a kite-square cross-section.
Figure 8:
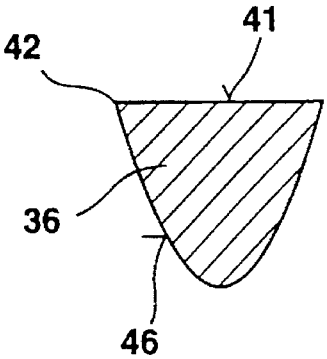
FIG. 8 illustrates an atomizing structure according to the present invention having a first partially curved cross-section.
Figure 9:
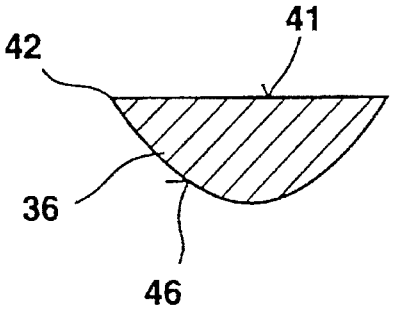
FIG. 9 illustrates an atomizing structure according to the present invention having a second partially curved cross-section.
Figure 10:
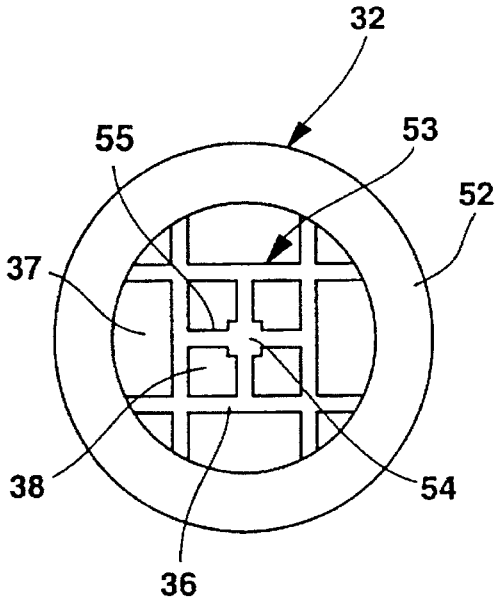
FIG. 10 illustrates an atomizing grid according to the present invention with a square basic structure.
Figure 11:
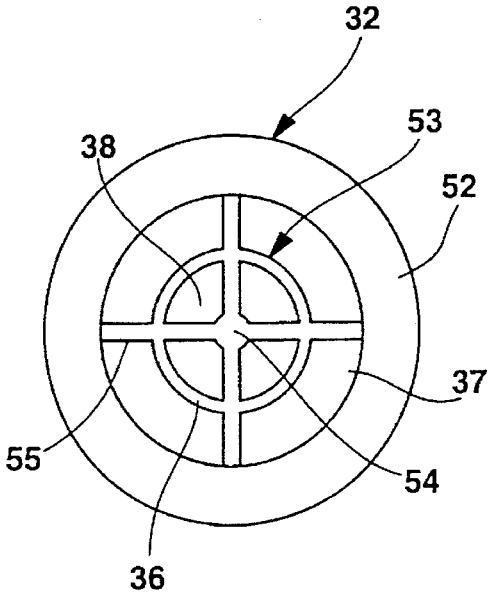
FIG. 11 illustrates an atomizing grid according to the present invention with a circular basic structure.
Figure 12:
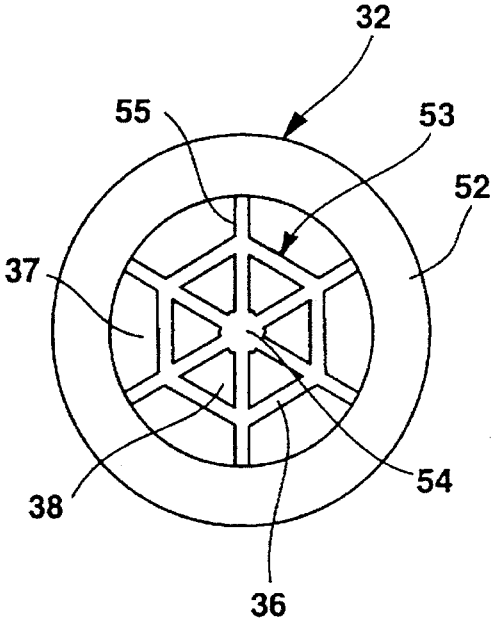
FIG. 12 illustrates an atomizing grid according to the present invention with a hexagonal basic structure.
Figure 13:
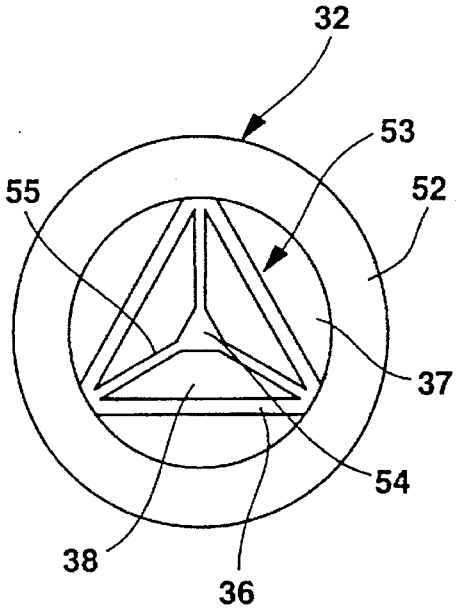
FIG. 13 illustrates an atomizing grid according to the present invention with a triangular basic structure.

Further exemplary embodiments of atomizing structures 36 are illustrated in FIGS. 6 and 7, the atomizing structures 36 here having a diamond-shaped and kite-square cross section, respectively. In these atomizing structures 36, the fuel does not strike a plane face 41 extending perpendicularly to the valve longitudinal axis 2, but strikes two faces 44 which extend obliquely relative to the valve longitudinal axis 2 and which, in addition to the two atomizing edges 42, also possess a further breakup edge 50 directed towards the valve closing body 7 and located exactly between the two oblique faces 44. The exemplary embodiments in FIGS. 8 and 9 each have a plane face 41 and a curved face 46, and the curved face 46 facing away from the valve closing body 7 can be formed both with a constant and with a variable radius. The transitions from the plane face 41 to the curved face 46 constitute in each case the two atomizing edges 42.

FIGS. 10 to 13 show exemplary embodiments of atomizing grids 32 according to the present invention in a top view and thus illustrate the arrangement of the atomizing structures 36 also in the radial extension. The circular atomizing grids 32 each have an outer annular edge zone 52 Which thus completely surrounds in the circumferential direction the middle region 37 having the atomizing structures 36 and the throughflow regions 38 obtained in between. The atomizing structures 36 can be made highly variable and be adapted to desired forms of fuel mists.

Thus, the atomizing structures 36 tend basically to have, for example, square (FIG. 10), circular (FIG. 11), hexagonal (FIG. 12) or triangular (FIG. 13) geometries.

In addition to this basic structure 53 in the atomizing grid 32, further atomizing webs 55 mostly passing through a midpoint 54 of the atomizing grid 32 and starting from the edge zone 52 are provided in the atomizing structures 36. According to the design of the basic structure 53 of the atomizing structure 36, these atomizing webs 55 intersect the latter at different angles. Thus, in the circular basic structure 53 (FIG. 11), the atomizing webs 55 run, for example, at right angles to one another from the edge zone 52 to the midpoint 54, while, in the hexagonal basic structure 53 (FIG. 12), the atomizing webs 55 form in each case an angle of 60°. In the triangular basic structure 53 (FIG. 13), the atomizing webs 55 are introduced, for example, at an angle of 120° in each case and run completely within the triangular basic structure 53, since the latter is likewise designed to start from the edge zone 52.

In contrast to this, the circular, square or hexagonal basic structure 53 is formed within the atomizing grid 32 at a radial distance from the edge zone 52. Since the atomizing webs 55 run from the edge zone 52 to the midpoint 54 and at the same time intersect the basic structure 53, throughflow regions 38 are obtained both between the edge zone 52 and the basic structure 53 and between the basic structure 53 and the midpoint 54. In the atomizing structure 36 having the hexagonal basic structure 53, six outer and six inner throughflow regions 38 are consequently formed by the atomizing webs 55. The atomizing structure 36 having the square basic structure 53 is designed, for example, in such a way that the atomizing webs 55 forming the square each run as far as the edge zone 52, while atomizing webs 55 are arranged in the form of a cross within the square basic structure 53, as a result of which four throughflow regions 38 are obtained within the basic structure 53. As a result of the arrangement of the atomizing webs 55, for example eight throughflow regions 38 are obtained between the square basic structure 53 and the edge zone 52, in each case four throughflow regions 38 having an identical size.

In order to produce the atomizing grids 32 as metal grids having these atomizing structures 36, for example the so-called LIGA (Lithography, Electroforming, Cast-taking) or MIGA (Microstructuring, Electroforming, Cast-taking) processes, which are particularly suitable for producing three-dimensional microstructures, are employed. The LIGA process is described in more detail, for example, in Heuberger: "Mikromechanik" ("Micromechanics"), Springer-Verlag 1989, page 236 ff., and in Reichl: "Micro System Technologies 90", Springer-Verlag 1990, page 521 ff.

In a first process step, a resist structuring is carried out by means of optical lithography. The corresponding structures are transferred from a mask onto the resist-coated substrate surface, for example by means of projection exposure. After the resist development, there is on the carrier a structured resist profile which can now be further processed. Since the possibilities for the micromechanical use of resist profiles are limited, galvanoplastic forming of the resist structures is appropriate. All metals suitable for electroplating (for example, nickel sulfamate) come under consideration as materials for this purpose.

The metallic structures obtained after the electroforming can subsequently be duplicated by means of conventional cast-taking techniques. For this purpose, it is necessary first to produce a plastic intermediate mold, from which the final workpiece can then be produced, for example by means of electrochemical cast-taking. It is particularly advantageous in the LIGA process that a multiplicity of materials can be used, for example metals, plastics or ceramics, and production of large quantities is possible at the same time. By means of the processes mentioned, atomizing structures 36 and atomizing webs 55 having a maximum width of between <50 μm and 200 μm and an axial extension, that is to say a profile height, of around 200 μm can be produced without difficulty.

The atomizing structures 36 can also be produced, for example, by means of plastic injection-molding. Some plastics resistant to fuels, particularly polyether ether ketone (PEEK), polyphenylene sulfide (PPS), epoxy resin (EP) and phenol resin (PH), are suitable for this purpose. By injection-molding, highly accurate structures having sharp atomizing edges 42 can likewise be achieved. In view of a desired inherent stability, the individual atomizing webs 55 should have a minimum width at their widest point of 100 μm and a minimum profile height of 100 μm. Moreover, the atomizing structures 36 can be produced perfectly well by means of known silicon technology, for example by etching.

Figure 14:
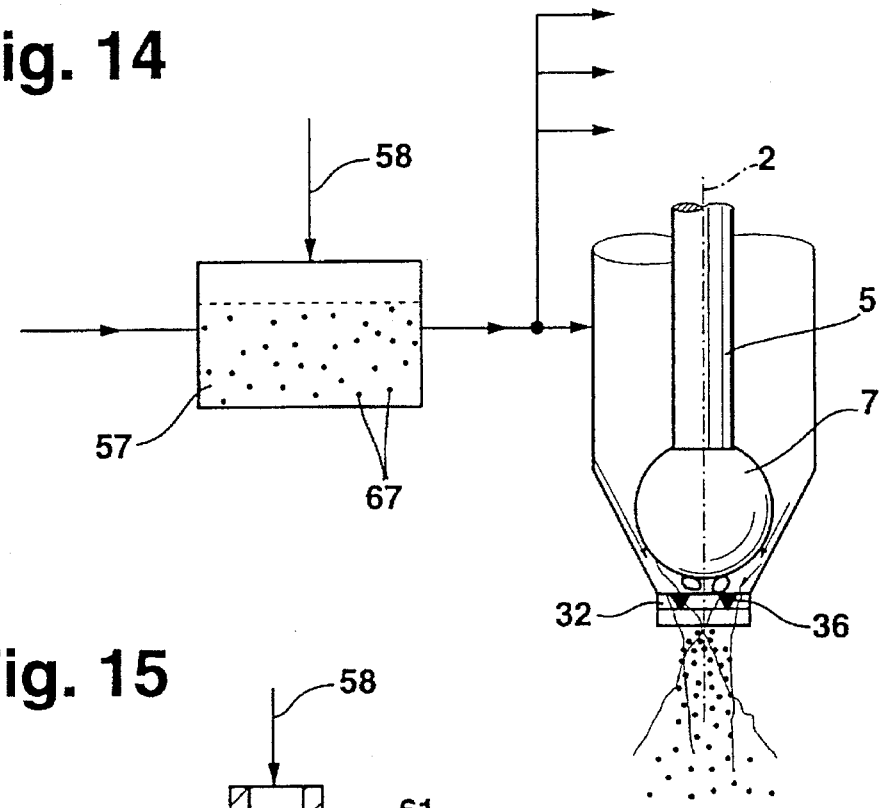
FIG. 14 shows a diagrammatic representation of the fuel injection device according to the present invention with a gas blow-in device.

A further improvement in the atomizing quality of the fuel can be achieved according to the present invention if the fuel is mixed with gas, for example with air. FIG. 14 shows a diagrammatic representation of a fuel injection device according to the present invention in which a gas blow-in device 57 precedes an injection valve having the atomizing structure 36 according to the present invention. The gas blow-in device 57 is arranged, for example, between a mass flow sensor (not shown) and the injection valve. The gas feed 58 into the gas blow-in device 57 takes place, for example, perpendicularly to the fuel flow direction.

Figure 15:
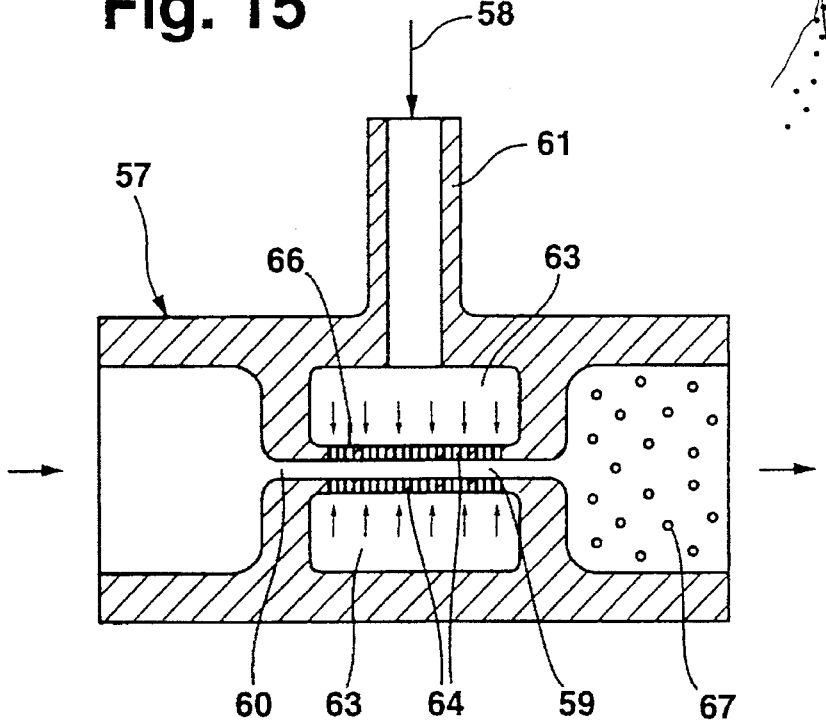
FIG. 15 illustrates an exemplary embodiment of a gas blow-in device.

In FIG. 15, an exemplary embodiment of a gas blow-in device 57 is shown diagrammatically, enlarged in relation to FIG. 14, once again as an individual component. The gas blow-in device 57 is designed in such a way that a marked cross sectional narrowing 60 is provided for the fuel in a middle gas blow-in region 59. In the gas blow-in region 59, therefore, a narrow gap is present for the throughflow of the fuel. The velocity of the fuel increases appreciably on account of the cross sectional narrowing 60, the pressure energy stored in fuel flowing in at a system pressure being converted into kinetic energy. The gas is then blown into the fuel having a low overpressure of, for example, 0.5 bar.

For feeding the gas serving for improved treatment and atomization of the fuel, an inlet connection piece 61 is provided on the gas blow-in device 57. The gas used can, for example, be the suction air branched off upstream of a throttle flap by means of a bypass in a suction pipe of the internal combustion engine, air conveyed by an additional blower, but also returned exhaust gas from the internal combustion engine or a mixture of air and exhaust gas. The use of returned exhaust gas makes it possible to reduce the emission of harmful substances from the internal combustion engine. The feed of the gas up to the gas blow-in device 57 is not shown in any more detail.

The gas flows out from the inlet connection piece 61 into a chamber 63 which is limited relative to the cross sectional narrowing 60 by a disk-shaped blow-in grid 64. The gas blow-in device 57 can also be designed in such a way that gas can be blown into the fuel via two chambers 63 and two blow-in grids 64, while the chambers 63 can be connected to one another or can also be supplied with gas separately from one another via different inlet connection pieces 61. It is possible, furthermore, to provide a chamber 63 with an annular cross section and with a tubular blow-in grid 64 limiting it on the inside. Instead of the blow-in grid 64, a plurality of small perforated tubes can also be employed in the gas blow-in device 57. The gas passes directly into the fuel via orifices 66 formed in the blow-in grid 64.

To obtain the desired fuel pressure directly after the gas has been blown in, the mixture of fuel and gas bubbles 67 is braked, for example by enlarging the cross section for the fuel flow again to the size of the cross section at the inlet into the gas blow-in device 57. With an increasing pressure, the gas bubbles 67 in the mixture are compressed. On account of the surface tension between the gas and fuel, depending on the bubble size, the pressure in the gas bubbles 67 is correspondingly higher than the mixture pressure. Up to a specific gas concentration in the mixtures; a bubbly flow still prevails in the injection valve.

Directly downstream of the sealing edge 39, the gas bubbles 67 expand abruptly during injection. The operation is referred to as bubble explosion which ensures very fine atomization according to the "shear-type" mechanisms for the decomposition of the fuel. The sharp-edged atomizing structure 36 then immediately thereafter ensures a further improvement in the atomizing quality according to the operations already described. When fuel with gas bubbles 67 is used, the spray-hole disk 21 should be dispensed with between the sealing edge 39 and the atomizing structure 36, in order to avoid bubble blockage in the spray holes 25.

Figure 16:
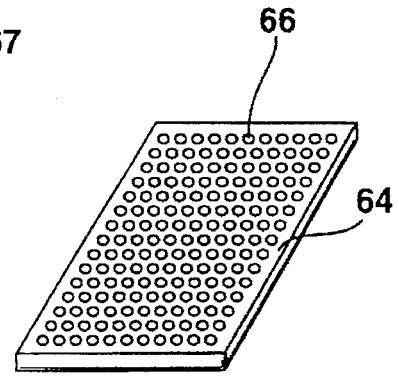
FIG. 16 illustrates a blow-in grid for a gas blow-in device.

An exemplary embodiment of a blow-in grid 64 according to the present invention is shown in FIG. 16. Here, the blow-in grid 64 is a rectangular basic body, the edge lengths of which are, for example, between 1 mm and 5 mm and in which a multiplicity of orifices 66 are arranged in a sieve-like manner, prompting reference to a perforated foil. The LIGA process already described can also be used very well for producing the blow-in grid 64. The blow-in grids 64 can be produced in very large quantities with high dimensional accuracy. Instead of the blow-in grid 64 shown in FIG. 16, other sieve-like or grid-shaped blow-in means are also possible. Since very small structures can be manufactured with precision by means of the LIGA process, it is possible at any time to provide the blow-in grid 64 with orifices 66 having diameters of, for example, between 10 μm and 50 μm.

What is claimed is:

1. A fuel injection valve for a fuel injection system of an internal combustion engine, the fuel injection valve having a longitudinal valve axis, comprising:

a valve closing body;

a valve seat body including a valve seat face, the valve closing body movably cooperating with the valve seat face;

a spray hole disk having at least one spray orifice disposed below the valve closing body; and an atomizing grid disposed below the at least one spray orifice, the atomizing grid including an atomizing structure, the atomizing structure having an at least partially varying first cross-section at points along the longitudinal valve axis and defining at least one throughflow region, the at least one throughflow region having an at least partially varying second cross-section at points along the longitudinal valve axis.

2. The fuel injection valve according to claim 1, wherein the at least partially varying first cross-section of the atomizing structure of the atomizing grid includes an at least partially varying triangular cross-section.

3. The fuel injection valve according to claim 2, wherein the atomizing structure having the at least partially varying triangular cross-section includes a plane face extending in a direction perpendicular to the longitudinal valve axis and facing the valve closing body, the plane face being limited by a first atomizing edge and a second atomizing edge, and a triangle vertex facing away from the valve closing body.

4. The fuel injection valve according to claim 1, wherein the at least partially varying first cross-section of the atomizing structure of the atomizing grid includes an at least partially varying square cross-section.

5. The fuel injection valve according to claim 4, wherein the atomizing structure having the at least partially varying square cross-section is formed as a kite square, the kite square forming a breakup edge facing the valve closing body and at least one additional atomizing edge downstream of the breakup edge.

6. The fuel injection valve according to claim 1, wherein the at least partially varying first cross-section of the atomizing structure of the atomizing grid includes an at least partially curved cross-section.

7. The fuel injection valve according to claim 6, wherein the atomizing structure having the at least partially curved cross-section includes a curved face facing away from the valve closing body and a plane face having at least one atomizing edge facing towards the valve closing body.

8. The fuel injection valve according to claim 1, wherein the atomizing grid has a circular shape and includes an annular edge zone surrounding a middle region, the middle region including the atomizing structure.

9. The fuel injection valve according to claim 8, wherein the atomizing structure includes a basic geometrical structure connected at least partially via an atomizing web to the edge zone.

10. The fuel injection valve according to claim 8, wherein the atomizing structure includes a basic geometrical structure extending directly from the edge zone.

11. The fuel injection valve according to claim 9, wherein the atomizing web passes through a midpoint of the atomizing grid.

12. The fuel injection valve according to claim 9, wherein the basic geometrical shape includes a polygon.

13. The fuel injection valve according to claim 9, wherein the basic geometrical shape includes a circle.

14. The fuel injection valve according to claim 1, wherein the atomizing structure is formed via one of a LIGA process, a MIGA process, a plastic injection molding and an etching process.

15. The fuel injection valve according to claim 1, further comprising a gas blow-in device, the gas blow-in device blowing gas bubbles into fuel to be sprayed by the fuel injection valve.

16. The fuel injection valve according to claim 15, wherein the gas blow-in device provides a direct feed of gas to the fuel via at least one blow-in grid, the at least one blow-in grid having a plurality of orifices.

17. The fuel injection valve according to claim 16, wherein the at least one blow-in grid is produced via one of a LIGA process and a MIGA process.

* * * * *